US006366237B1

(12) United States Patent
Charles

(10) Patent No.: US 6,366,237 B1
(45) Date of Patent: Apr. 2, 2002

(54) ADJUSTABLE-TILT ANTENNA

(75) Inventor: Jean-Pierre Charles, Guyancourt (FR)

(73) Assignee: France Telecom, Paris (FR)

( * ) Notice: Subject to any disclaimer, the term of this patent is extended or adjusted under 35 U.S.C. 154(b) by 0 days.

(21) Appl. No.: 09/304,385

(22) Filed: May 4, 1999

(30) Foreign Application Priority Data

Feb. 24, 1999 (FR) ..... 99 02587

(51) Int. Cl.[7] ..... H01Q 3/26

(52) U.S. Cl. ..... 342/368; 455/403; 455/422; 455/550; 455/561; 455/562

(58) Field of Search ..... 343/792.5; 455/403, 455/422, 550, 561, 502; 342/368–377

(56) References Cited

U.S. PATENT DOCUMENTS

| | | | | |
|---|---|---|---|---|
| 4,249,181 A | | 2/1981 | Lee | |
| 5,565,873 A | * | 10/1996 | Dean | 342/372 |
| 5,570,098 A | * | 10/1996 | Searle et al. | 342/374 |
| 5,576,717 A | * | 11/1996 | Searle et al. | 342/373 |
| 5,596,329 A | * | 1/1997 | Searle et al. | 342/374 |
| 5,602,555 A | * | 2/1997 | Searle et al. | 342/374 |
| 5,666,123 A | * | 9/1997 | Chrystie | 342/373 |
| 5,745,858 A | * | 4/1998 | Sato et al. | 455/562 |
| 5,771,017 A | * | 6/1998 | Dean et al. | 342/374 |
| 5,818,385 A | | 10/1998 | Bartholomew | |
| 5,917,455 A | * | 6/1999 | Huynh et al. | 343/792.5 |

FOREIGN PATENT DOCUMENTS

| | | |
|---|---|---|
| EP | 0443484 | 8/1991 |
| WO | 9614670 | 5/1996 |
| WO | 9821779 | 5/1998 |
| WO | 9848472 | 10/1998 |

OTHER PUBLICATIONS

Wilson, G., "Electrical Downtilt Through Beam–Steering Versus Mechanical Downtilt" from Pioneers to the 21st Century, Denver, May 10–13, 1992, vol. 1, No. CONF. 42, May 10, 1992, pp. 1–4, XP000339669, Institute of Electrical and Electronics Engineers ISBN, 0–7803–0673–2.

EP 0 624 919 (NIPPON Telegraph & Telephone), Nov. 17, 1994, p. 12, line 32, to p. 14, line 30, Figures 32–37.

* cited by examiner

*Primary Examiner*—Bernarr E. Gregory
(74) *Attorney, Agent, or Firm*—Ladas & Parry

(57) ABSTRACT

The present invention lies in the field of antennas for land cellular radio communications networks, and it relates to a remote control method for adjusting the tilt of the radiation pattern relative to the horizontal of the antennas of a base station. The invention also relates to an antenna fitted with means for adjusting its tilt and to a system for remote control of the tilt. The technical field of the invention is active antennas (also known as "smart" antennas or as "adaptive" antennas) for networks for communicating with mobile telecommunications terminals. According to the invention, an antenna for a land cellular telecommunications network, the antenna comprises radiating elements and feeder means for feeding said radiating elements with radio frequency signals; said feeder means include electronic phase shifter means for obtaining phase shifts between said signals so as to enable the tilt of the radiation pattern in a vertical plane to be adjusted remotely.

18 Claims, 3 Drawing Sheets

ADJUSTABLE-TILT ANTENNA

FIELD OF THE INVENTION

The present invention lies in the field of antennas for land cellular radio communications networks, and it relates to a remote control method for adjusting the tilt of the radiation pattern relative to the horizontal of the antennas of a base station.

The invention also relates to an antenna fitted with means for adjusting its tilt and to a system for remote control of the tilt.

The technical field of the invention is active antennas (also known as "smart" antennas or as "adaptive" antennas) for networks for communicating with mobile telecommunications terminals.

BACKGROUND OF THE INVENTION

When optimizing their networks, one of the problems encountered by cellular network operators is associated with monitoring the radio coverage provided by each base station. One of the means used for adjusting such coverage consists in modifying the tilt of the antenna (i.e. the angle at which its radiation pattern slopes relative to the horizontal) for the purpose of reducing (or sometimes increasing) the range of a base station; tilt modification is also used to reduce interference caused by a base station serving a remote cell in which the same spectrum resources are used in order to increase the capacity of the network.

At present, and in both cases, it is necessary to take action on site (which is expensive since it is necessary to use the services of an antenna-installation specialist), and to adjust the tilt of the antenna mechanically.

U.S. Pat. No. 4,249,181 (LEE) describes a cellular mobile radiotelephone mobile system in which radio frequencies are allocated to cells that are located adjacent to one another in order to form a network covering a service zone; at least one directional antenna system is provided in each cell; an antenna comprises a plurality of collinear dipoles fed in-phase; in order to tilt the axis of a lobe of the radiation pattern of the antenna in a vertical plane to beneath the horizontal, the antenna is fixed on a mast by means of a tilted mechanical support that may be fixed or adjustable, so as to increase the efficiency of coverage in the cell served by the antenna (relative to the situation in which the axis is horizontal).

Adjusting tilt by adjusting a mechanical antenna support requires on-site intervention which is expensive. It is also impossible with that system to adjust the radio coverage of a cell in accurate manner without multiple on-site interventions.

Such a mechanical device for adjusting the inclination of the antenna also suffers from the drawback of deforming the radiation pattern of the antenna in the horizontal plane.

It is also possible to use antennas in which the radiation pattern is tilted by phase shifting the signals fed to the individual antennas making up the antenna.

International application WO 98/21779(HUYNH), filed Nov. 12, 1997 and printed May 22, 1998, describes an antenna in which beam tilt is electrically variable; the antenna has radiating elements forming three groups of elements disposed along a screen; a phase adjustment mechanism is disposed between the second and third groups of antenna elements and comprises:

an inlet coupling element;

a moving coupling portion having one end pivotally mounted which is electromagnetically coupled to the inlet coupling element;

a semicircular transmission line portion which is coupled to a second end of the moving portion; and a drive mechanism for the moving portion, which mechanism includes an electric motor that can be remotely controlled and monitored.

The electrical path lengths at the operating frequency are such that when the moving portion is in a middle position, they give rise to progressive phase shifting between the radiating elements which result in the radiation pattern being tilted through about 7° below the horizontal; this tilt is adjustable in the range 0 to 14° by displacing the moving portion (using the motor), thereby modifying the electrical path lengths, and consequently the relative phases of the signals delivered to the radiating elements.

That electromechanical phase shifting device is designed to make it possible to control remotely the tilt of the radiation pattern, in particular as a function of variations in demand level during holiday or weekend periods; the system suffers from certain drawbacks: it does not enable phase shifting to be varied quickly; in addition, its reliability is limited by the reliability of the electromechanical mechanism for modifying the electrical path lengths.

OBJECTS AND SUMMARY OF THE INVENTION

An object of the present invention is to provide apparatus for varying the tilt of the radiation pattern of such an antenna which is capable of being remotely controlled which is improved, and which, at least in part, remedies the drawbacks of known devices.

In a first aspect, the invention consists in providing an antenna for a land cellular telecommunications network, the antenna comprising radiating elements and feeder means for feeding said radiating elements with radio frequency (RF) signals; said feeder means include electronic phase shifter means for obtaining phase shifts between said signals so as to enable the tilt of the radiation pattern in a vertical plane to be adjusted remotely, in particular the axis of the main lobe of the pattern.

The electronic phase shifting means comprise one or more phase shifting cells each generally constituted by three components disposed successively in series: a splitter circuit; a static phase shifter circuit connected to one of two outputs of the splitter to deliver a phase shifted signal at its output; and a coupler having two inputs in quadrature.

The static phase shifter circuit is preferably constituted by an array of fixed phase shifter elements, each associated with a diode (or an RF relay) for switching the phase shifter element, with conduction of the diodes (or closure of the relays) being under the control of a digital control signal applied to the phase shifter circuit; the circuit preferably includes PIN type switching diodes.

By using a phase shifter circuit having two, three, or four phase shifter elements together with their associated diodes (or relays), a 2-, 3-, or 4-bit digital phase shifter is made available.

The invention thus provides a device that is very simple, accurate, very reliable, compact, of low cost, easy to control remotely, and capable of varying the tilt of the radiation pattern of an antenna in less than 1 microsecond ($\mu$s), in particular when diodes are used, since the very short switching time thereof can be of the order of 10 nanoseconds (ns) to 100 ns.

The device of the invention also gives rise to little distortion of the radiation pattern in a horizontal plane.

In order to modify the tilt of the antenna, electronic devices (phase shifters) are inserted in the radio frequency feed circuit of the antenna for the purpose of causing the radiation pattern to tilt in a vertical plane. Such an electronic device can be remotely powered via the coaxial cable connecting the base station to the antenna. Controlling the electronic device (digitally or by analog means) makes it possible to adjust the value of the tilt to a value that has been predetermined by the operator (in steps of 1degree, for example). It is possible for control to be performed remotely from the base station, for example at the unit which controls and operates the cellular network. The installed remote control makes it possible to adjust tilt in real time without human intervention on the antenna.

The ability to adjust antenna tilt by means of an electronic device makes it possible in time division multiple access (TDMA) cellular networks (of the GSM type), to control radiation pattern tilt individually for each time slot (frame) by varying tilt at a frequency that is equal to the reciprocal of the TDMA frame duration, and thus to do so mobile terminal by mobile terminal, as a function of level or quality information received at the radio interface. Adjusting tilt for each ongoing call can be used in addition to controlling power so as to adjust the useful signal level and so as to reduce the level of an interfering signal situated within the aperture of the antenna.

An electronic device for phase shifting an elementary antenna is integrated within each antenna. Control of that device makes it possible to adjust antenna tilt. When control is performed remotely, an operator can adjust tilt without taking any particular action on the antenna. When measurements performed on the network show that tilt needs to be modified in order to reduce interference or to modify radio coverage, tilt can likewise be modified without extra cost.

If all of the antennas of a cellular network are fitted with the device, then there is no longer any need to install antenna tilting apparatus, nor is it necessary to specify to the antenna manufacturer, where appropriate, that an antenna should be supplied having a predetermined tilt value.

Most cellular network antennas are used in duplex mode (transmission and reception via the same antenna); the electronic device makes it possible to obtain identical electrical tilt on the up path and on the down path.

The electronic device included within the antenna-protecting dome is thus essentially constituted by phase shifters whose control signals can be conveyed by a coaxial cable that also carries the radio signals to be transmitted. Because control is performed in digital form, it is possible to integrate control in cellular network equipment after the antenna has begun to be used.

Thus, in another aspect, the invention consists in a method of controlling a plurality of antennas of the invention in which each antenna has delivered thereto a digital signal for controlling its electronic phase shifter means.

In preferred implementations of the invention:

- the digital control signal is carried by a coaxial cable which also carries radio signals;
- tilt value is adjusted periodically; and
- said digital signal for varying the tilt of the radiation pattern is controlled at a frequency that is equal to the reciprocal of the duration of a TDMA frame so as to determine the tilt of the radiation pattern during each frame period for each telecommunications mobile terminal served by the antenna as a function of level or quality information concerning the signal received by the mobile terminal.

BRIEF DESCRIPTION OF THE DRAWINGS

The advantages provided by the invention will be better understood from the following description which refers to the accompanying drawings, which show preferred embodiments of the invention that are not of limiting character.

In the drawings, elements that are identical or similar are given the same references from one figure to another, unless otherwise indicated.

MORE DETAILED DESCRIPTION

Figure 1:
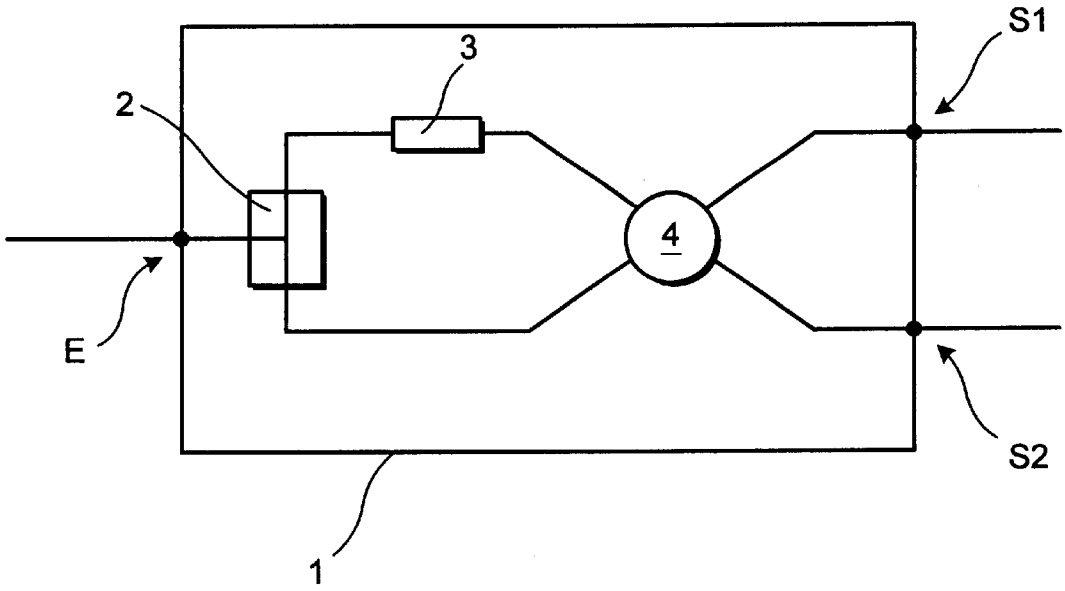
FIG. 1 shows a phase shifter cell for an antenna in accordance with the invention.

Electronic phase shifter means of the invention enable the power of the radio frequency signals as delivered to the input (E) of the antenna 9 by means of a cable 13 to be shared between each of the radiating elements 5 to 8 (half-wavelength dipole for an adjustable-tilt antenna). This distribution is performed by means of elementary phase shifter cells 1 (FIG. 1). Each cell 1 has a split tee 2 (for splitting the signal in two), a 2- or 3-bit phase shifter (reference 3), and a coupler (reference 4) having 3 dB loss and quadrature outputs (S1, S2) serving to feed two dipoles each (5 or 6 or 7 or 8) in a symmetrical configuration; the first inlet of the coupler 4 is connected to the outlet of the phase shifter 3; a second inlet of the coupler is connected to the (non-phase shifted) outlet of the splitter 2.

Figure 4:
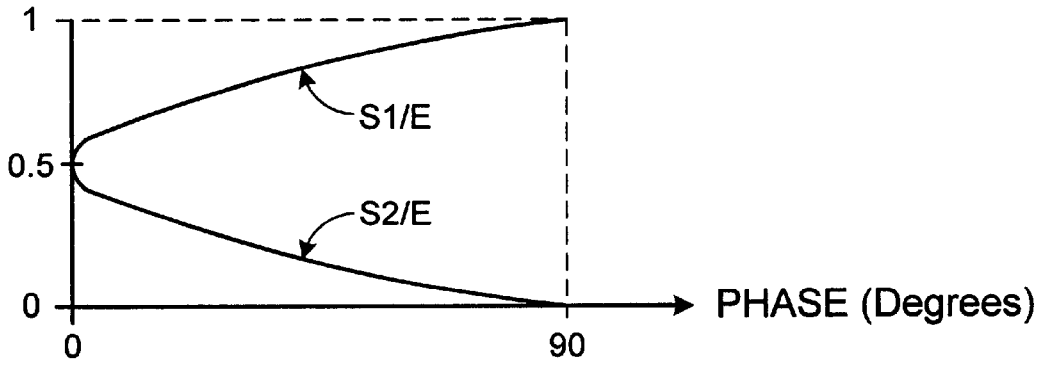
FIG. 4 is a graph showing how the power of the two signals output by a phase shifter cell varies as a function of a phase shifting command signal applied to the cell.

When phase varies between 0° and 90° at the phase shifter, power distribution varies as follows (FIG. 4):

- at zero phase shift: the input power is shared 50% to S1 to 50% to S2); and
- for 90° phase shift: the input power is shared 0% to S2 and 100% to S1.

Figure 2:
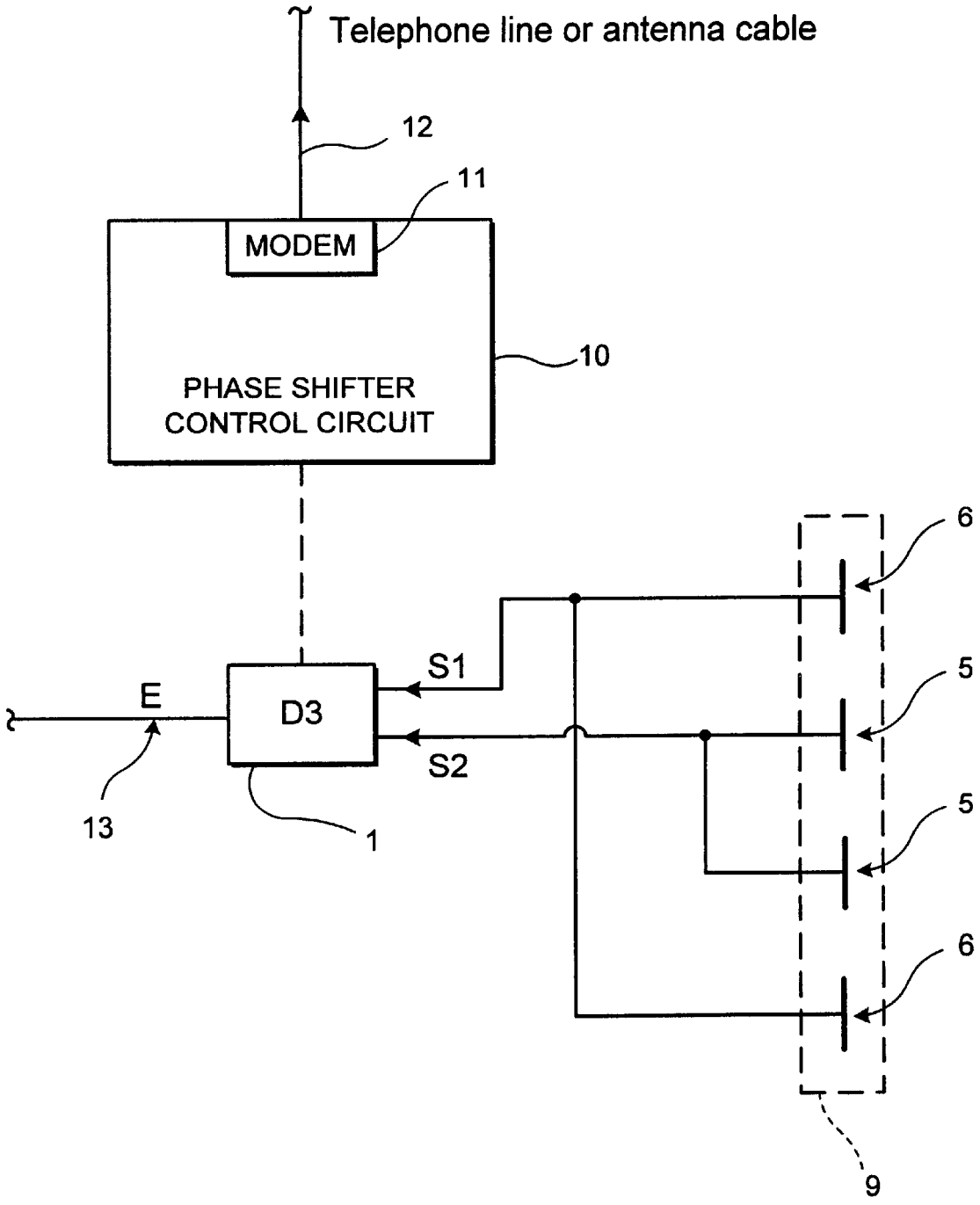
FIG. 2 shows the use of the FIG. 1 phase shifter cell which is inserted in the feeder circuit of a four-dipole antenna.
Figure 3:
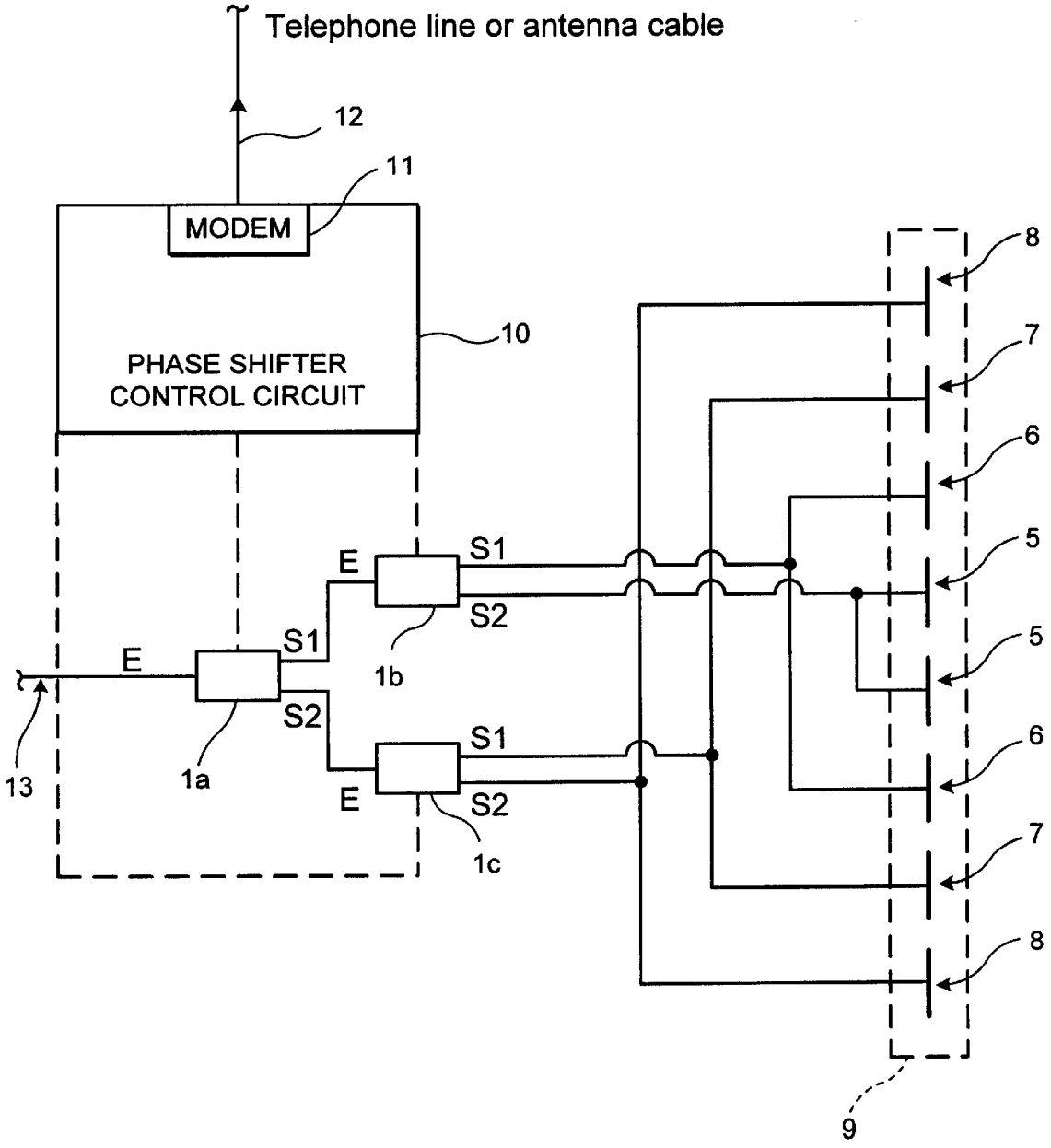
FIG. 3 is a diagram showing a device for tilting the radiation pattern of an eight-dipole antenna by means of three phase shifter cells as shown in FIG. 1.

By putting elementary cells in cascade, it is possible to adjust the tilt of the antenna in very fine manner. Two embodiments are shown, in particular for an antenna made up of eight elementary dipoles (FIG. 3) and for an antenna made up of four dipoles (FIG. 2), however the principle can be extended to an antenna having 16 or 32 radiating elements, in particular.

If 3-bit phase shifter cells are used (giving eight different phase-shift values), then with an eight-dipole antenna, it is possible to obtain 512 tilt values for the radiation pattern.

Each output S1, S2 of two couplers respectively fitted to the two phase shifters 1*b* and 1*c* is connected to two of the radiating elements of the antenna 9.

A control circuit 10 provides each of the phase shifters 1*a*, 1*b*, and 1*c* (FIG. 3) with a binary combination (on 3 bits each in the preceding example) to obtain the desired tilt value. The control circuit and the phase shifters are integrated within the dome of the antenna 9. A modem 11 makes it possible to control the phase shifter circuit remotely, and thus to adjust tilt.

It is possible to use the coaxial cable 13 which connects the antenna to the base station for remotely powering all of the electronics integrated in the antenna. Similarly, the modem 11 can be connected to the coaxial cable 12 for transmitting remote control information for the phase shifters as delivered by apparatus for controlling operation of a cellular network.

Each phase shifter 3 can be constituted by a fixed array of elements that are switchable by means of diodes (or by radio frequency relays) under digital control; such phase shifters are available, in particular, from General Microwave Corp., Amityville, N.Y., USA, and/or Narda Microwave, N.Y., USA.

What is claimed is:

1. An antenna for a land celluar telecommunications network, the antenna comprising:

radiating elements having a radiation pattern in a vertical plane;

feeder means for feeding said radiating elements with radio frequency signals, said feeder means including eletronic phase shifter means for obtaining phase shifts between said signals so as to remotely adjust tilt of said radiation pattern, wherein said electronic phase shifter means comprise several phase shifter cells, each of said shifter cells having a phase shifter circuit including a plurality of static components for switching a fixed phase shifter element, and wherein each of said phase shifter cells is connected to a control circuit for digitally controlling said phase shifter cells, said control circuit including a modem for remotely controlling the phase shifter means.

2. An antenna according to claim 1, wherein said electronic phase shifter means comprise several phase cells which are put in cascade.

3. An antenna according to claim 2, in which said phase shifter circuit is constituted by an array of fixed phase shifter elements each of which is associated with a diode.

4. An antenna according to claim 2, in which said phase shifter circuit is constituted by an array of fixed phase shifter elements each of which is associated with a switching diode.

5. An antenna according to claim 2, in which the phase shifter circuit is constituted by an array of fixed phase shifter elements each of which is associated with a radio frequency relay.

6. An antenna according to claim 2, in which the control circuit for the cells is connected to a device for controlling a plurality of network antennas by a cable that also serves to convey said radio frequency signals.

7. An antenna according to claim 1, in which said electronic phase shifter means comprise a phase shifter cell associated with a group of four radiating elements, said phase shifter cell comprising, successively connected in series:

a splitter circuit;

a phase shifter circuit connected to one of the two outlets of the splitter circuit to output a phase-shifted signal; and a coupler having two outputs in quadrature, each output from the coupler being connected to two radiating elements.

8. An antenna according to claim 7, in which said phase shifter circuit is constituted by an array of fixed phase shifter elements each of which is associated with a switching diode.

9. An antenna according to claim 8, in which the diodes are of the PIN type and have a switching duration of the order of 10 ns to 100 ns.

10. An antenna according to claim 7, in which the phase shifter circuit is constituted by an array of fixed phase shifter elements each of which is associated with a radio frequency relay.

11. An antenna according to claim 7, in which the control circuit for the cells is connected to a device for controlling a plurality of network antennas by a cable that also serves to convey said radio frequency signals.

12. An antenna according to claim 1, in which the control circuit for the cells is connected to a device for controlling a plurality of network antennas by a cable that also serves to convey said radio frequency signals.

13. An antenna according to claim 1, in which said phase shifter circuit is constituted by an array of fixed phase shifter elements each of which is associated with a switching diode.

14. An antenna according to claim 1, in which the phase shifter circuit is constituted by an array of fixed phase shifter elements each of which is associated with a radio frequency relay.

15. A method of controlling a plurality of land cellular telecommunications network antennas, each antenna comprising radiating elements and feeder means for feeding said radiating elements with radio frequency signals, said feeder means including electronic phase shifter means for obtaining phase shifts between said signals, comprising the steps of:

transmitting a digital signal to each antenna for controlling said electronic phase shifter means, so as to remotely adjust the tilt of the radiation pattern in a vertical plane.

16. The method of claim 15, which the digital signal is carried by a coaxial cable for conveying radio frequency signals.

17. The method of claim 16, in which a tilt value in the digital signal is adjusted periodically.

18. The method of claim 15, further including the steps of:

controlling said digital signal for varying the tilt of the radiation pattern at a frequency which is equal to the reciprocal of the TDMA frame duration, thereby enabling the tilt of the pattern to be determined for each frame period for each telecommunications mobile terminal served by the antenna, as a function of level or quality information concerning the signal received by the mobile terminal.

* * * * *